United States Patent [19]

Vecchione

[11] 3,955,395

[45] May 11, 1976

[54] RIVET SETTING TOOL

[75] Inventor: John S. Vecchione, Sturbridge, Mass.

[73] Assignee: Parker Manufacturing Co., Worcester, Mass.

[22] Filed: Mar. 17, 1975

[21] Appl. No.: 558,621

[52] U.S. Cl. ..... 72/391
[51] Int. Cl.[2] ..... B21J 15/34
[58] Field of Search ..... 72/391

[56] References Cited

UNITED STATES PATENTS

| | | | |
|---|---|---|---|
| 3,154,210 | 10/1964 | Elliott | 72/391 |
| 3,302,444 | 2/1967 | Elliott | 72/391 |
| 3,326,030 | 6/1967 | DiMaio | 72/391 |
| 3,426,572 | 2/1969 | Lahnston | 72/391 |
| 3,596,496 | 8/1971 | LaPointe | 72/391 |
| 3,782,165 | 1/1974 | Bosch | 72/391 |

*Primary Examiner*—C. W. Lanham
*Assistant Examiner*—Gene P. Crosby
*Attorney, Agent, or Firm*—Norman S. Blodgett; Gerry A. Blodgett

[57] ABSTRACT

This disclosure has to do with a rivet setting tool, and, more particularly, apparatus for setting separable mandrel rivets. The apparatus includes a blocking plate which intersects the path of the mandrel at all times during the operation of the apparatus for setting, so that the mandrel is not propelled out of the tool while the tool is being operated. In this way, the operator is protected from being struck by the mandrel during operation of the tool to set the rivets.

8 Claims, 3 Drawing Figures

RIVET SETTING TOOL

BACKGROUND OF THE INVENTION

It has become common practice to fasten sheet metal and like objects together by use of a special rivet which is provided with a separable mandrel. The rivet itself is a hollow element through which extends a nail-like mandrel. When pressure is brought on top of the rivet while pulling on the mandrel the rivet collapses, thus forming the rivet on either side of the elements to be fastened together. The mandrel breaks and is no longer associated with the rivet. A number of tools have been developed for performing this function of setting the rivet, but they have all been quite expensive and complicated. Furthermore, they have not been completely successful, since they have required extremely large pressing forces to operate them. They have been subject to a number of disabilities due to being complicated and difficult to maintain in operating condition. Furthermore, most designs involve an exit port out of which the mandrel is driven as the tool operates. The necessary location of that exit port is in a place where the operator might accidently apply pressure with his hand. As a result, the mandrel may be driven into the operators hand. In addition, the operation of some rivet setters can result in the unexpected expulsion of the broken mandrel from the exit port with sufficient velocity to be dangerous to an operator who is not using sufficient care. These and other difficulties experienced with the prior art devices have been obviated in a novel manner by the present invention.

It is, therefore, an outstanding object of the invention to provide a rivet setting tool of simple, rugged construction.

Another object of this invention is the provision of a rivet setting tool which is inexpensive to manufacture.

A further object of the present invention is the provision of a rivet setting tool which requires a minimum of maintenance.

It is another object of the instant invention to provide a rivet setting tool which does not require large amounts of energy to operate.

It is a further object of the invention to provide a rivet setting tool which eliminates the possibility that the mandrel will be unexpectedly expelled from the tool.

A still further object of the invention is the provision of a rivet setting tool which is simple in construction, inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the present invention relates to a rivet setting tool having an elongated lower handle with a hollow head at one end and an elongated upper handle having one end lying in the said hollow head and connected thereto for pivotal movement about a second transverse pin substantially spaced from the first pin lengthwise of the lower handle, and a gripper is mounted on the support arm for pivotal movement about a third transverse pin. A first spring means is provided for biasing the upper handle and the support arm from one another and a second spring means biases the gripper and the support arm. Furthermore, a fourth pivot pin extends between the upper handle and the support arm so that, as the upper and lower arms are brought together by pivotal movement about the first pin, the fourth pin causes pivotal movement of the support arm with the gripper about the second pin. A blocking plate attached to the upper handle blocks the path of the mandrel of a rivet while the tool is setting the rivet, but the blocking plate is moved out of the path when the upper handle is moved to an inoperative position.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
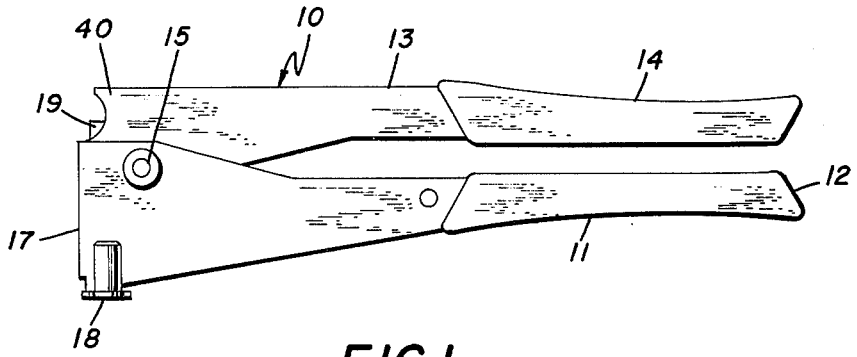
FIG. 1 is a side elevational view of a rivet setting tool embodying the principles of the present invention.

Referring first to FIG. 1, which best shows the general features of the invention, the rivet setting tool, indicated generally by the reference numeral 10, is shown as consisting of an elongated lower handle 11 covered at one end with a plastisol coating 12. An upper handle 13 is provided with a plastisol coating 14. The handles are pivoted together by a first pivot pin 15. The lower end 11 is provided with a hollow head 17 and an anvil 18 is located in its lower portion.

Figure 2:
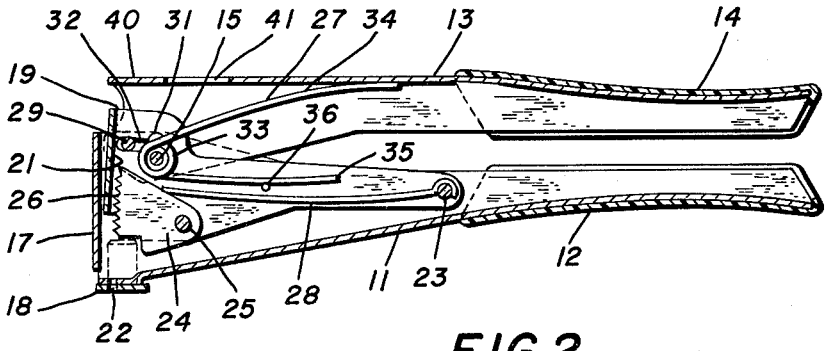
FIG. 2 is a vertical sectional view through the tool.
Figure 3:
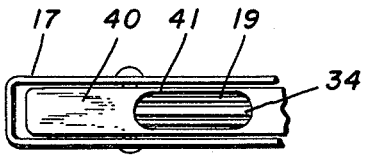
FIG. 3 is a plan view of an end of the tool.

Referring now to FIG. 2, which shows the details of construction of the invention, it can be seen that both handles are hollow and that the upper handle has one end lying within the hollow head 17 of the lower handle, the first pivot pin extending entirely through the lower handle and through the upper handle. Also located within the hollow head is a support arm 19 which is formed of a flat piece of steel folded back upon itself to form a U, the bight of the U forming a clamping surface 21. This clamping surface is generally lined with an aperture 22 or input port formed in the anvil 18, the aperture being of a diameter slightly larger than the diameter of the mandrel of the rivet which is to be set by the tool. The aperture, clamping surface and an exit port above the clamping surface define a path through which the of a ofa rivet will be moved by the operation of the tool. The blocking plate 40 which is part of the upper handle 13 intersects the path when the upper handle is in its operating positions. The exception is when the upper handle is in an extreme outward position thus placing the window 41 across the path.

The support arm lies within the hollow head 17 and is connected thereto for pivotal movement about a second transverse pin 23. This pin is located in the intermediate portion of the lower handle 11 and, of course, is substantially spaced from the first pin 15 lengthwise of the lower handle.

A gripper 24 is mounted on the support arm for pivotal movement about a third transverse pin 25. The gripper is of a generally segmented shape and is provided with an arcuate serrated surface 26 which is normally pressed against the clamping surface 21 of the support arm. The first spring means 27 biases the upper handle and the support arm away from one another. A second spring means 28 biases the gripper and the support arm to cause the serrated surface 26 of the gripper to press against the clamping surface 21, thus forming a grasping means. A fourth pivot pin 29 extends between the upper handle 13 and the support arm 19 so that, as the upper and lower arms are brought together by pivotal movement about the first pin 15. The fourth pin 29 causes pivotal movement of the support arm with the gripper about the second pin 23.

As has been stated, the gripper 24 has a serrated surface 26 which is spaced a substantial distance from the third pin 25 and the support arm 19 has a clamping surface 21 engageable by the serrated surface; the hollow head 17 of the lower arm 11 has an anvil 18 with an aperture 22 adapted to receive the shank or mandrel of a rivet, the said serrated surface of the gripper and the said clamping surface being generally aligned with the aperture to receive and grip the mandrel of a rivet.

As is evident in the drawing, the first, second, and fourth pins are in a general line with one another and the second and fourth pins are located on opposite sides of the first pin 15. The fourth pin 25 is located in the hollow head 17 of the lower handle 11 and is located at a substantial distance laterally of an imaginary line joining the other three pins 29, 15, and 23. The first pin 15 passes through a laterally-extending slot 31 formed in the support art 19 and the said second pin 23 extends through the lower handle 11 approximately midway of its ends. The fourth pin 29 extends from side to side of the upper handle 13 and extends through a longitudinally-extending slot 32 formed in the support arm.

The first spring means 27 is a wire spring having a central coil 33 through which the first pin 15 extends and is provided with a first leg 34 which presses against the bight of the upper handle 13 and a second leg 35 which extends from the coil and presses against a pin 36 by which the latch loop 16 is pivotally connected to the support arm 19.

The said second spring means 28 is a length of wire which extends between the second pin 23 and a part of the gripper 24 which is spaced from the third pin 25.

The operation of the rivet setting tool 10 will now be readily understood in view of the above description. First, the separable mandrel rivet is placed through the apertures in the materials which are to be riveted together. The mandrel extends from the sheet from the rivet proper and the tool is placed over the mandrel so that the mandrel extends through the aperture 22 in the anvil 18. As the mandrel is pushed upwardly, eventually, it forces its way between the serrated surface 26 of the gripper 24 and the clamping surface 21 of the support arm 19 forcing them apart. The tool is forced down on the mandrel until the surface of the anvil 18 hits the top of the rivet. Then, the handle 13 and the handle 11 are squeezed together, the operator gripping the plastisol coatings 12 and 14. When the handles are squeezed together the upper handle 13, in effect, pivots about the first pin 15 which extends through the lower handle 11. It acts as a first degree lever with respect to the fourth pin 29 and the fourth pin moves upwardly in FIG. 2. The pressure of the pin 29 against the surfaces of the slot 32 in the support arm 19 cause the support arm to pivot upwardly about the second pin 23. The mandrel, of course, does not wish to go upwardly with the clamping surface 21 and the serrated surface 26, so that the teeth of the serrated surface 26 bite into the mandrel and a downward pull of the mandrel while the support arm 19 and the gripper 24 are being moved upwardly cause the gripper 24 to tend to pivot even tighter toward the clamping surface 21. The mandrel is tightly gripped in this way and is pulled upwardly as the handles 11 and 13 are pressed together so that the rivet proper begins to collapse. Usually, one movement of the handles together, however, is not sufficient to completely collapse the rivet and to separate the mandrel. Therefore, it is necessary for the operator to allow the handles 11 and 13 to move apart again under the impetus of the first spring means 27. At that time, the gripper 24 and the clamping surface 21 seize a portion of the mandrel closer to the rivet (since the rivet has been compressed somewhat and the anvil 18 can move further on down on the mandrel). The next motion of the handles together will, in most cases, cause the complete collapse of the rivet and completion of its flanging on the tool side of the material to be riveted. At the same time, it causes a breaking of the mandrel, since the mandrel is deliberately manufactured to break at the time when sufficient force has been placed upon it to cause the complete collapse of the rivet. The tool gripping the broken portion of the mandrel is carried away from the rivet and by releasing the handles the gripper 24 and the clamping surface 21 can be moved apart for the removal of the mandrel from the tool. The other end of the mandrel falls away from the rivet, since it is no longer part of the portion of the mandrel which lies in the tool.

The blocking plate 40 intersects the path of the mandrel while the tool is being operated and allows the operator to apply pressure directly over the rivet without the risk that the mandrel will be driven upward along the path into his hand. Also, when the mandrel breaks it sometimes is thrown from the exit port with dangerous velocity. The blocking plate stops it from escaping from the tool.

When the rivet setting operation is complete, the tool can be inverted and the handles opened to their extreme. This opening places the window 41 in the path and releases the mandrel from the grasping means, allowing the mandrel to fall through the window.

It can be seen, then, that the present invention provides a rivet setting tool which is relatively simple in construction and in operation. It is inexpensive to manufacture and, because of its ruggedness and simplicity, it is capable of having a very long life without any need for extensive maintenance. Because of the ingenious mechanical leverage arrangement, it is possible to cause the upsetting of the rivet by pulling on the mandrel with a minimum of force on the handles 11 and 13.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A rivet setting tool for setting a rivet having a mandrel, comprising a. a lower handle having an input port, b. an upper handle, c. a grasping means operated by movement of the upper handle to cause the mandrel to move along a path passing through the input port, the grasping means, and an exit port in the direction from the grasping means opposite that of the input port, d. a blocking plate which intersects the path to limit the movement of the mandrel along the path, the blocking plate being adapted so that it can be removed from the path from time to time, but must intersect the path whenever the tool is being operated to set rivets.

2. A tool as recited in claim 1, wherein the blocking plate is attached to the upper handle.

3. A tool as recited in claim 1, wherein the blocking plate is integral with the upper handle and is moved out of the path by placing the upper handle in a position at which the gripper disengages the mandrel.

4. A rivet setting tool as recited in claim 1, wherein a. the lower handle has a hollow head at one end, b. the upper handle has one end lying in the hollow head and is connected thereto for pivotal movement about a first transverse pin, c. a support arm is provided and lies within the hollow head and is connected thereto for pivotal movement about a second transverse pin substantially spaced from the first pin lengthwise of the lower handle, d. a gripper is mounted on the support arm for pivotal movement about a third transverse pin, the support arm and the gripper forming the grasping means, e. a first spring means is provided and biases the upper handle and the support arm, f. a second spring means is provided and biases the gripper and the support arm, g. a fourth pivot pin extending between the upper handle and the support arm is provided so that, as the upper and lower arms are brought together by pivotal movement about the first pin, the fourth pin causes pivotal movement of the support arm with the gripper about the second pin.

5. A rivet setting tool as recited in claim 4, wherein the gripper has a serrated surface spaced a substantial distance from the said third pin and the support arm has a clamping surface engageable by the serrated surface and wherein the head of the lower arm has an anvil through which the input port passes, the input port being adapted to receive the mandrel of a rivet, the said serrated surface of the gripper and the said clamping surface being generally aligned with the input port to receive and grip the said mandrel of a rivet.

6. A rivet setting tool as recited in claim 5, wherein the first, second, and fourth pins are in alignment, wherein the second and fourth pins are located on opposite sides of the first pin, wherein the fourth pin is located at the extreme end of the upper handle within the hollow head of the lower handle, and wherein the third pin is located a substantial distance laterally of an imaginary line joining the other three pins.

7. A rivet setting tool as recited in claim 6, wherein the first pin passes through a laterally-extending slot in the support arm.

8. A rivet setting tool as recited in claim 6, wherein the fourth pin extends through a longitudinally-extending slot formed in the support arm.

* * * * *